US010374302B2

(12) United States Patent
Kobayashi

(10) Patent No.: US 10,374,302 B2
(45) Date of Patent: Aug. 6, 2019

(54) ANTENNA UNIT

(71) Applicant: Harada Industry Co., Ltd., Tokyo (JP)

(72) Inventor: Hidekazu Kobayashi, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 15/386,140

(22) Filed: Dec. 21, 2016

(65) Prior Publication Data

US 2017/0104264 A1 Apr. 13, 2017

Related U.S. Application Data

(63) Continuation of application No. PCT/JP2015/068345, filed on Jun. 25, 2015.

(30) Foreign Application Priority Data

Jun. 26, 2014 (JP) ..... 2014-131020

(51) Int. Cl.
*H01Q 1/42* (2006.01)
*H01Q 1/32* (2006.01)
*H01Q 1/12* (2006.01)

(52) U.S. Cl.
CPC ..... *H01Q 1/42* (2013.01); *H01Q 1/1214* (2013.01); *H01Q 1/3275* (2013.01)

(58) Field of Classification Search
CPC ..... H01Q 1/3275; H01Q 1/1214; H01Q 1/42
USPC ..... 343/872
See application file for complete search history.

(56) References Cited

U.S. PATENT DOCUMENTS 7,429,958 B2 9/2008 Lindackers et al.
2006/0082509 A1* 4/2006 Lee ..... H01Q 1/22 343/702
2006/0273968 A1 12/2006 Noro
2007/0075904 A1* 4/2007 Blickle ..... H01Q 1/1214 343/715

(Continued)

FOREIGN PATENT DOCUMENTS

CN 2596564 Y 12/2003
CN 103268975 A 8/2013

(Continued)

OTHER PUBLICATIONS

International Search Report dated Sep. 1, 2015 for corresponding PCT Application No. PCT/JP2015/068345.

(Continued)

*Primary Examiner* — Huedung X Mancuso
(74) *Attorney, Agent, or Firm* — Hauptman Ham, LLP

(57) ABSTRACT

A base plate where at least part of an antenna member is disposed, an inner cover attached to the base plate so as to cover at least part of the antenna member, and an outer cover covering the inner cover on the base plate, a locking claw for fixing the outer cover is provided on the inner cover side. A fixing piece engaged with the locking claw is provided on the outer cover side, an engaging portion of the fixing piece is formed as a concave surface instead of the through opening. The configuration eliminates the need for providing the fixing piece with a claw-shaped protrusion, damage of the fixing piece can be prevented. In addition, the fixing piece is not readily subject to a defect such as a weld, so that increased mechanical strength can be improved.

4 Claims, 13 Drawing Sheets

(56) References Cited

U.S. PATENT DOCUMENTS

| | | | | |
|---|---|---|---|---|
| 2008/0084994 | A1* | 4/2008 | Chuang | H04M 1/0252 379/433.11 |
| 2008/0122708 | A1 | 5/2008 | Lindackers et al. | |
| 2009/0201216 | A1* | 8/2009 | Gerneth | H01Q 1/002 343/872 |
| 2010/0141534 | A1* | 6/2010 | Sato | H01Q 1/12 343/702 |
| 2010/0231467 | A1* | 9/2010 | Schnuerer | H01Q 1/1214 343/713 |
| 2011/0128194 | A1* | 6/2011 | Sekine | H01Q 9/16 343/702 |
| 2011/0195761 | A1* | 8/2011 | Lee | G03B 17/02 455/575.4 |
| 2013/0285877 | A1* | 10/2013 | Desclos | H01Q 1/42 343/872 |
| 2016/0104932 | A1* | 4/2016 | Aminzadeh | H01Q 1/3275 343/872 |

FOREIGN PATENT DOCUMENTS

| | | | |
|---|---|---|---|
| JP | 2000-341016 | A | 12/2000 |
| JP | 2001-223511 | A | 8/2001 |
| JP | 2006-345083 | A | 12/2006 |
| JP | 2012-085044 | A | 4/2012 |
| JP | 2014-060652 | A | 4/2014 |
| WO | 2008/067034 | A1 | 6/2008 |

OTHER PUBLICATIONS

Written Opinion of the International Searching Authority for PCT/JP2015/068354 dated Sep. 1, 2015.

Written Opinion of the International Searching Authority for PCT/JP2015/068345 dated Sep. 1, 2015.

Chinese Office Action dated Nov. 2, 2018 for the corresponding Chinese application No. 201580033141.6, With partial English translation.

Chinese Office Action issued on May 8, 2019 for the corresponding Chinese application No. 201580033141.6, With partial English translation.

Indian Office Action issued on May 29, 2019 for the corresponding Indian application No. 201617043682, With partial English translation.

* cited by examiner

Enlarged view of a region M1

Enlarged view of a region M1

ANTENNA UNIT

CROSS REFERENCE TO RELATED APPLICATIONS

This application is based upon and claims the benefit of priority from the prior Japanese Patent Application No. 2014-131020, filed on Jun. 26, 2014 and PCT Application No. PCT/JP2015/068345, filed on Jun. 25, 2015, the entire contents of which are incorporated herein by reference.

FIELD

The present invention relates to antenna unit and, for example, to an assembly structure of an antenna unit to be mounted on a mobile body such as an automobile.

BACKGROUND

An antenna unit installed on a roof of a vehicle or the like has a structure in which a base plate is fixed to an exterior plate and an outer cover appearing externally is mounted on the base plate so that an antenna member is contained inside. In this antenna unit, the outer cover is uniquely shaped and colored to improve not only functionality but also design quality.

As an antenna unit of this type, one in a double case structure configured of a base plate, an inner cover, and an outer cover has been known. In this case, the base plate is fixed to a vehicle main body, and the outer cover is mounted so as to cover the base plate and the inner cover. For example, in the case of the double case structure, to allow the outer cover to be mountable after the inner plate is attached to the base plate, an engaging part is provided which fixes the outer cover and the base plate, or the outer cover and the inner cover.

In the engaging part to mount the outer cover on the base plate or the inner cover, in many cases, a structure is adopted in which a fixing piece having a locking claw is provided to the outer cover and an engaging part which engages with the locking claw is provided on a base plate or inner cover side (refer to Japanese Patent Application Laid-Open No. 2006-345083, U.S. Pat. No. 7,429,958, and Japanese Patent Application Laid-Open No. 2012-085044).

SUMMARY

An antenna unit according to one embodiment of the present invention includes a base plate where at least part of an antenna member is disposed and an outer cover provided on the base plate, the base plate has a locking claw which fixes the outer cover, and the outer cover has a fixing piece which engages with the locking claw.

According to this antenna unit, with the locking claw provided on a base plate side and the fixing piece which engages with the locking claw provided on an outer cover side, a claw-shaped protrusion does not have to be provided to the fixing piece. With this, damage of the fixing piece can be prevented.

An antenna unit according to one embodiment of the present invention includes a base plate where at least part of an antenna member is disposed, an inner cover attached to the base plate so as to cover at least part of the antenna member, and an outer cover covering the inner cover on the base plate, the inner cover has a locking claw which fixes the outer cover, and the outer cover has a fixing piece which engages with the locking claw.

According to this antenna unit, with the locking claw provided to the inner cover to be mounted on the base plate and the fixing piece which engages with the locking claw provided on an outer cover side, a claw-shaped protrusion does not have to be provided to the fixing piece. With this, damage of the fixing piece and operator's injury due to damage of the fixing piece can be prevented.

As another mode of the antenna unit according to one embodiment of the present invention, in the structure having the inner cover, the inner cover may have an opening at a position where the locking claw is provided, and the locking claw may be provided on an inner wall surface of the opening. Also, the fixing piece provided to the outer cover may be provided so as to fit in the opening of the inner cover.

With the opening provided in the inner cover and the locking claw provided on the inner wall surface of the opening, the locking claw can be prevented from being exposed outside. With the fixing piece of the outer cover provided so as to fit in the opening of the inner cover, even if an external force is applied to the outer cover, one end of the opening supports the fixing piece, and therefore the fixing piece can be prevented from being ruptured. Also, when the fixing piece engages with the locking claw, the opening supports the fixing piece. Therefore, even if swing or vibration acts on the antenna unit, the fixing piece can be prevented from being bent to be detached from the locking claw.

As another mode of the antenna unit according to one embodiment of the present invention, in the structure having the inner cover, a through hole may be provided in the base plate so as to match the opening of the inner cover. With this, an increase in pressure occurring in a space surrounded by the outer cover and the inner cover is prevented. Also, if water or the like infiltrated, water can be drained through the through hole.

As another mode of the antenna unit according to one embodiment of the present invention, the fixing piece provided to the outer cover preferably has the engaging part which engages with the locking claw formed as a recessed surface part. That is, this engaging part is formed as a recessed surface part with a depression provided at a position of engaging with the locking claw of the fixing piece and is not formed as a through hole, thereby capable of increasing mechanical strength.

DESCRIPTION OF EMBODIMENTS

Figure 1:
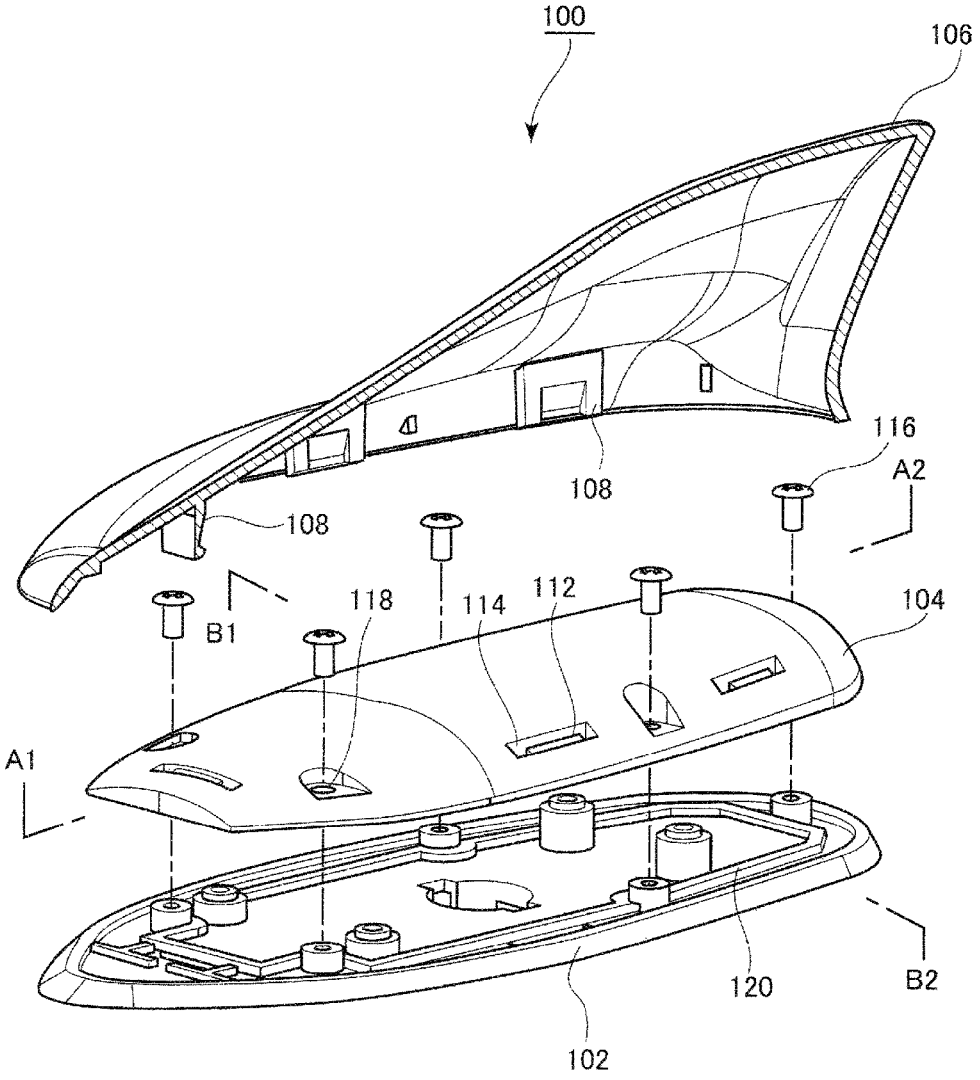
FIG. 1 is a perspective view describing the structure of an antenna unit according to one embodiment of the present invention.

In the following, embodiments of the present invention are described with reference to the drawings and others. However, the present invention can be implemented in many different modes, and should not be interpreted as being limited to details of the description of the embodiments exemplarily described below.

Note that in the details of the invention described in the following, a same reference character is commonly used among different drawings for same portions and portions having a similar function and, in that case, repetitive description is omitted unless there are special circumstances.

The antenna unit described in Japanese Patent Application Laid-Open No. 2006-345083 has a structure in which the outer cover fits in the inner cover, the locking claw is provided at the tip of the fixing piece provided to stand inside the outer cover. Therefore, a finger or glove may be caught when handling the outer cover, damaging the fixing piece and/or the locking claw to cause operator's injury.

In the antenna units described in U.S. Pat. No. 7,429,958 and Japanese Patent Application Laid-Open No. 2012-085044, as with Japanese Patent Application Laid-Open No. 2006-345083, the locking claw is provided to the fixing piece on an outer cover side. In a portion where this locking claw is formed, a penetrating opening (hole) is provided, and this is a factor in decreasing the strength of the fixing piece. That is, when the outer cover is injection-molded by using a resin material, the resin material is branched and then again merged at an opening portion of the fixing piece, a weld is formed at a merging point. When a weld is formed at the tip portion of the fixing piece, the strength of this portion decreases, and therefore rupture takes place in the fixing piece and/or the locking claw from the weld part, thereby problematically impairing attachment stability of the outer cover.

First Embodiment

Figure 2:
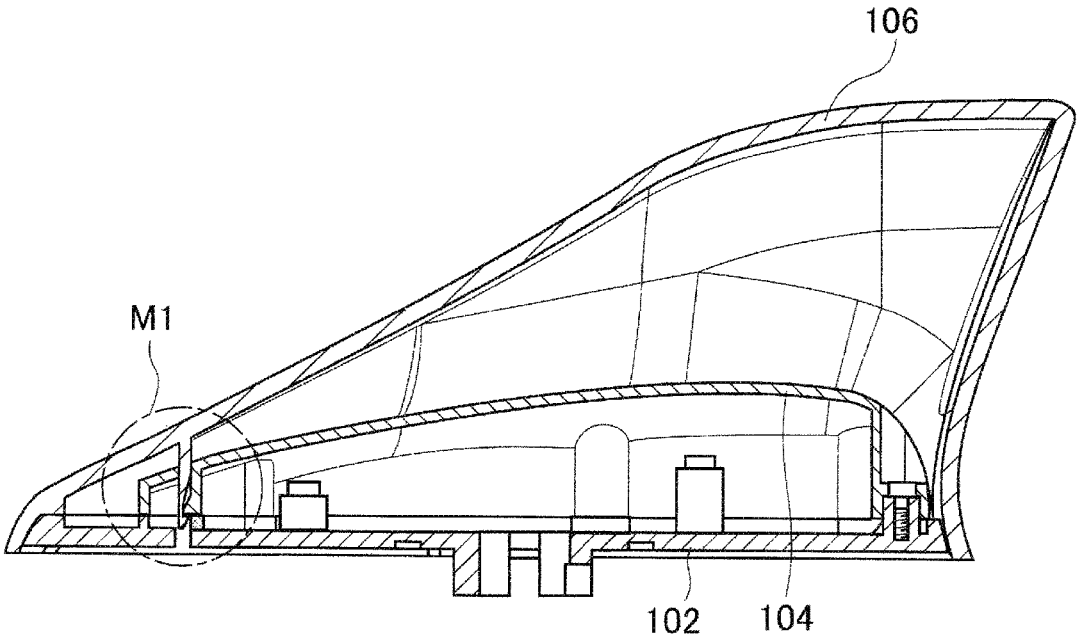
FIG. 2 is a sectional view describing the structure of the antenna unit according to one embodiment of the present invention.
Figure 2:
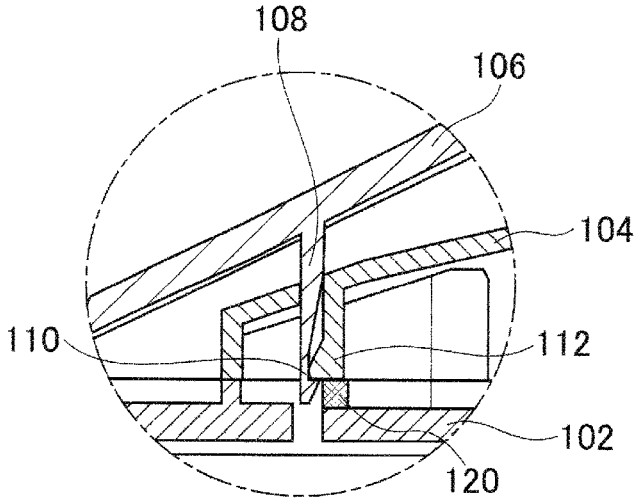
Figure 3:
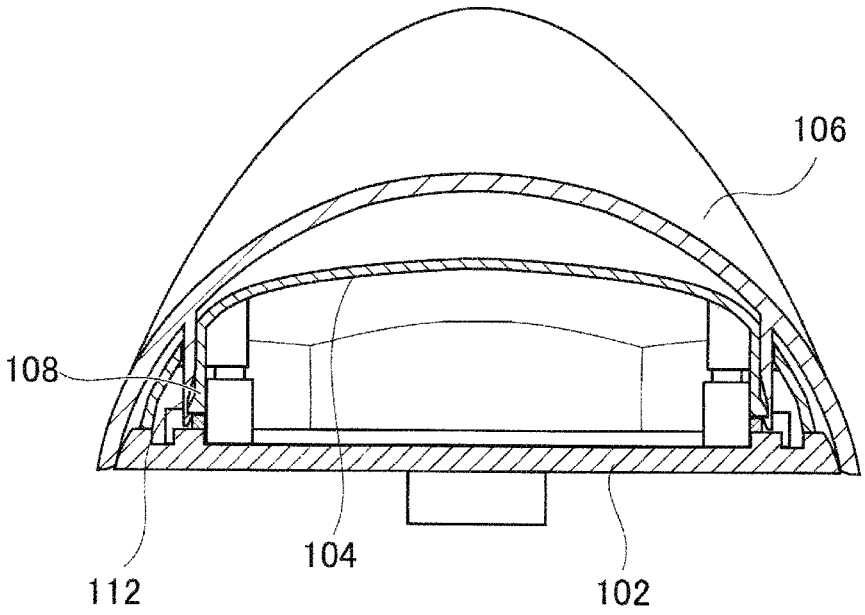
FIG. 3 is a sectional view describing the structure of the antenna unit according to one embodiment of the present invention.

An antenna unit according to one embodiment of the present invention is described with reference to the drawings. FIG. 1 is a perspective view of a base plate 102, an inner cover 104, and an outer cover 106 configuring an antenna unit 100 according to the present embodiment. Note that, for description, FIG. 1 depicts a state in which the base plate 102, the inner cover 104, and the outer cover 106 are each separated. Also, a sectional view along an A1-A2 cutting line depicted in FIG. 1 is depicted in FIG. 2, and a sectional view along a B1-B2 cutting line is depicted in FIG. 3. Note that, for convenience, as for the outer cover 106, FIG. 1 depicts a sectional part when cut out in an A1-A2 direction depicted in the drawing so that the sectional part is displayed forward in the drawing.

The antenna unit 100 is attached typically to a vehicle such as an automobile. However, other than that, the antenna unit according to the present embodiment can be attached to other various exterior surfaces.

The antenna unit 100 is configured to include the base plate 102, the inner cover 104, and the outer cover 106. Of these, the base plate 102 is mounted on an exterior plate of a vehicle or the like. Thus, the base plate 102 may have added thereto a fastening tool for fixing to the exterior plate or a fixing tool substituted therefor.

On an upper surface of the base plate 102, the inner cover 104 is mounted. The inner cover 104 is fixed to the base plate 102 at fastening parts 118 with fastening tools 116. While FIG. 1 depicts an example in which countersunk screws are used as the fastening tools 116, other fastening tools such as bolts and locking pins can also be used.

The outer cover 106 is attached onto the base plate 102 so as to cover the inner cover 104. Covered with the outer cover 106, the inner cover 104 is not exposed outside in a normal use state of the antenna unit 100. The outer cover 106 may not simply cover the inner cover 104 but also have contrived coloring and shape in consideration of aesthetic outer appearance, aerodynamic characteristics when the vehicle is running, and so forth. For example, as a form, the outer cover 106 may have a streamline shape such as one called "shark fin", and may have coloring suitable for the vehicle for installation.

The inner cover 104 and the outer cover 106 are fixed by a locking claw 112 and a fixing piece 108 provided with an engaging part 110 which engages with the locking claw 112. Note that the locking claw 112 is provided to the inner cover 104, and the fixing piece 108 is provided to the outer cover 106.

Preferably, the locking claws 112 are provided at a plurality of locations on the inner cover 104 and, for example, as depicted in FIG. 1 and FIG. 3, are preferably provided on both left and right sides of the inner cover 104 in a longitudinal direction. In this manner, with the locking claws 112 and the fixing pieces 108 engaged together at the plurality of locations, the outer cover 106 can be stably attached to the antenna unit 100. In addition to this, as depicted in FIG. 1 and FIG. 2, with the locking claw 112 provided also in a direction crossing the longitudinal direction, the outer cover 106 can be more stably fixed.

Note that as depicted in the sectional views of FIG. 2 and FIG. 3, the locking claw 112 is formed as a protruding member on a wall surface of an opening 114 of the inner cover 104. That is, the locking claw 112 is fixed to the wall surface of the inner cover 104, thereby making the structure strong.

By contrast, the fixing piece 108 is a plate-shaped member provided to stand from the inner wall surface of the outer cover 106 toward the inner cover 104. This fixing piece 108 is provided with the engaging part 110 which engages with the locking claw 112 provided to the opening 114 of the inner cover 104. This engaging part 110 is formed by making the fixing piece 108 depressed at a position engaging with the locking claw 112. With this, when the outer cover 106 is overlaid on the inner cover 104 to engage the fixing piece 108 and the locking claw 112 with each other, since the locking claw 112 is fixed to the wall surface of the inner cover 104, the fixing piece 108 is temporarily bent, thereby allowing a claw portion of the locking claw 112 to be engaged in the depression of the engaging part 110 of the fixing piece 108.

In FIG. 2, a mode in which the locking claw 112 and the fixing piece 108 are engaged with each other is depicted as an enlarged view of a region M1 surrounded by a one-dot chain line in the drawing. With reference to the enlarged view of the M1 part, a tip region of the fixing piece 108, that is, the engaging part 110 which engages with the locking claw 112, is molded in a recessed shape. In this manner, with the depression in the engaging part formed as a recessed surface part in a recessed shape, a force of engaging with the locking claw 112 can be made strong. And, with the claw portion of the locking claw 112 engaging with the recessed surface part in the engaging part 110 of the fixing piece 108, the inner cover 104 and the outer cover 106 are fixed. The shape of the locking claw 112 preferably has a so-called wedge-type shape in which the thickness of the protruding part gradually increases along a direction in which the fixing piece 108 is inserted so that the fixing piece 108 is easily bent.

In this manner, with the locking claw 112 provided to the inner cover 104 and the fixing piece 108 which engages with this locking claw 112 provided to the outer cover 106, a claw-shaped protrusion is not required to be provided to the fixing piece 108. With this, a finger or glove can be prevented from being caught when handling the outer cover to damage the fixing piece and cause operator's injury due to the damage of the fixing piece.

The locking claw 112 can be provided at any position of the inner cover 104 as long as the locking claw engages with the fixing piece 108 of the outer cover 106 at that position. As a preferable mode, as depicted in FIG. 1, the opening 114 may be provided to the inner cover 104, and the locking claw 112 may be provided to the inner wall surface of the opening 114. In this case, the fixing piece 108 provided to stand on the inner wall surface of the outer cover 106 is inserted in this opening 114, thereby being engaged with the locking claw 112.

With reference to the enlarged view of the M1 part depicted in FIG. 2, a state is depicted in which the fixing piece 108 is inserted into the opening 114 of the inner cover 104 to engage with the locking claw 112. In this engaged state, the structure is preferably such that at least one end of the opening 114 is in contact with or extremely in the vicinity of the fixing piece 108. With one end of the opening 114 provided in the inner cover 104 in contact with or extremely in the vicinity of the fixing piece 108, even if an external force is applied to the outer cover 106, one end of the opening 114 can support the fixing piece 108, and therefore the fixing piece 108 can be prevented from being damaged. Also, when the fixing piece 108 engages with the locking claw 112, at least one end part of the opening 114 supports the fixing piece 108. Therefore, even if swing or vibration acts on the antenna unit 100, the fixing piece 108 can be prevented from being detached from the locking claw 112 or bent.

In the above, an example in which the locking claw is provided on the inner wall surface of the opening of the inner cover is described, but this is not meant to be restrictive. For example, the locking claw can be provided to the surface of the inner cover. In this case, an opening is not required to be provided. Also, the locking claw can be provided at the tip of a plate-shaped elastic body extending from part of the inner cover.

Figure 4A:
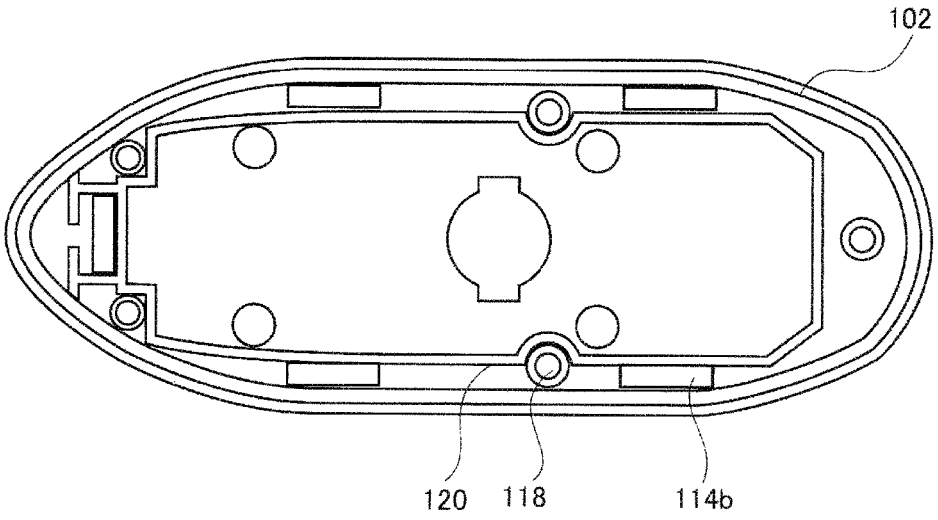
FIG. 4A is a plan view describing the structure of a base plate of the antenna unit according to one embodiment of the present invention.
Figure 4B:
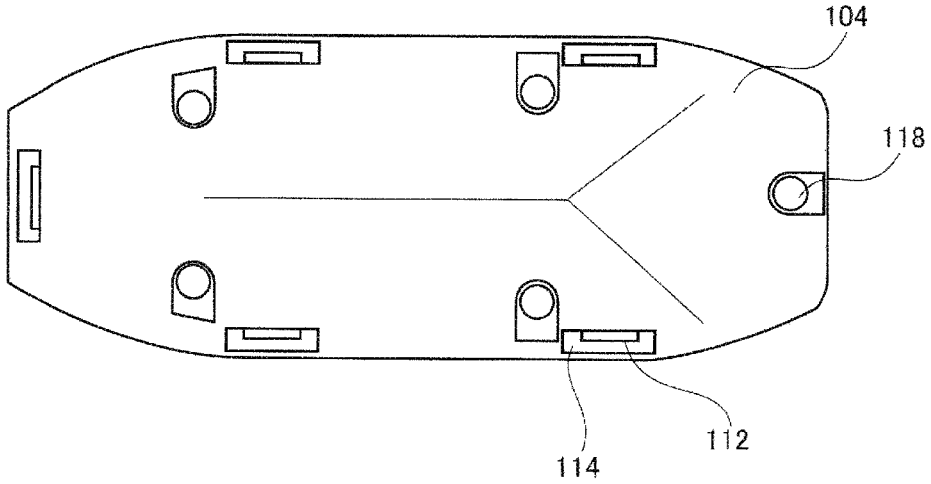
FIG. 4B is a plan view describing the structure of an inner cover of the antenna unit according to one embodiment of the present invention.
Figure 4C:
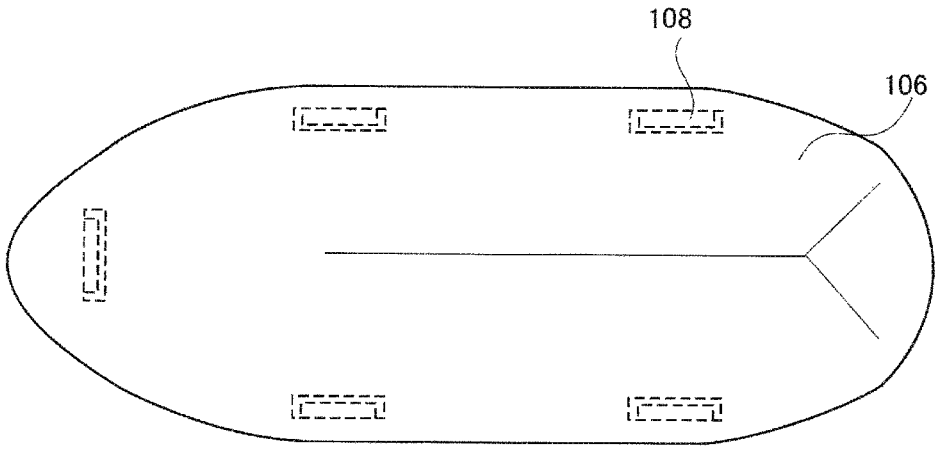
FIG. 4C is a plan view describing the structure of an outer cover of the antenna unit according to one embodiment of the present invention.

FIG. 4A, FIG. 4B, and FIG. 4C depicts details of each part configuring the antenna unit 100. FIG. 4A depicts a plan view of the base plate 102, FIG. 4B depicts a plan view of the inner cover 104, and FIG. 4C depicts a plan view of the outer cover 106.

In FIG. 4A, the base plate 102 is provided with the fastening part 118 for fixing the inner cover 104. A seal member 120 is arranged in an inner region of these fastening parts 118. With the base plate 102 and the inner cover 104 fastened by the fastening tools at the fastening parts 118 across the seal member 120, an inner region surrounded by the seal member 120 is configured to prevent infiltration of water or the like from outside.

In FIG. 4B, the inner cover 104 is provided with the locking claws 112 at a position corresponding to the fixing pieces 108. The inner cover 104 depicted in FIG. 4B is further provided with the openings 114. When the openings 114 are provided in the inner cover 104, the locking claw 112 is preferably provided to the inner wall surface of the opening 114. Also, the inner cover 104 may be provided with the fastening parts 118 for fixation with the base plate 102. The fastening part 118 is provided with a through hole for insertion of the fastening tool, and so forth.

In FIG. 4C, when the outer cover 106 is viewed from the upper surface, the fixing pieces 108 do not appear on the outer surface of the outer cover 106, and are provided inside the outer cover 106. While the shape of the outer cover 106 is any, for example, as depicted in the drawing, at least paired left and right fixing pieces 108 are preferably provided along a longitudinal direction of the outer cover 106. In addition to this, by providing the fixing piece 108 also in a direction crossing the longitudinal direction, the outer cover 106 can be stably fixed as described above.

Also, an opening 114*b* is provided also in the base plate 102 at a position overlaying the opening 114 of the inner cover 104. This opening 114*b* is an opening penetrating through the base plate 102. With the presence of this opening 114*b*, the structure is such that an inner space surrounded by the inner cover 104 and the outer cover 106 and an outer space surrounding the antenna unit communicate with each other. With this structure, internal pressure of the inner space surrounded by the inner cover 104 and the outer cover 106 is prevented from increasing. Also, even if water or the like infiltrates, water can be drained to the outside through the openings 114 and 114*b*.

In consideration of a more specific example, when the antenna unit according to the present embodiment is installed in a vehicle such as an automobile, even if high-pressure water is applied at car wash and water infiltrates into the inside of the outer cover, that water can be drained from the openings. Also, the fixing pieces can be moved by using a jig or the like, and therefore the outer cover can be easily replaced.

In the antenna unit according to the present embodiment, the locking claw is not provided to the fixing piece 108 of the outer cover 106, but the locking claw 112 is provided to the inner cover 104, thereby reliably fixing the outer cover 106 and preventing damage of the fixing piece 108. Details about this are described with reference to FIG. 5A and FIG. 5B.

Figure 5A:
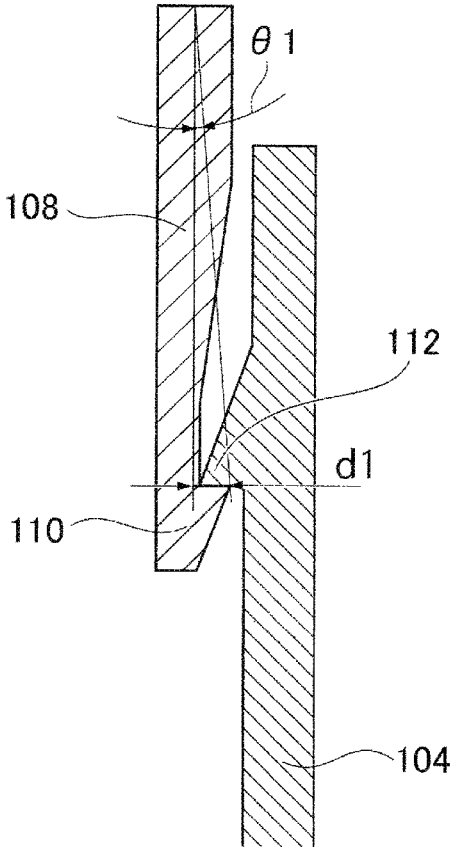
FIG. 5A is a diagram describing a relation between a fixing piece and a locking claw in which depicts a structure according to one embodiment of the present invention.

FIG. 5A depicts a structure according to the present embodiment, in which the locking claw 112 is provided to an inner cover 104 side, and the fixing piece 108 is provided to an outer cover 106 side. On the other hand, FIG. 5B depicts a conventional structure, in which a protruding locking claw 112*b* is provided at the tip of a fixing piece 108*b* on an outer cover 106 side and an engaging part 110*b* which engages with this locking claw 112*b* is provided to a wall surface of an inner cover 104 side so as to be in a protruding shape.

Figure 5B:
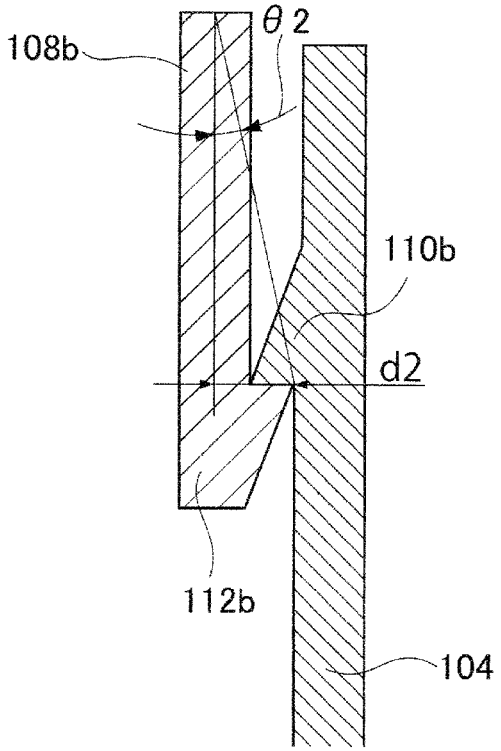
FIG. 5B is a diagram describing a relation between a fixing piece and a locking claw in which depicts a structure according to a conventional locking claw.

FIG. 5A and FIG. 5B both depict a state in which the fixing piece 108 (or the fixing piece 108*b*) engages with the engaging part. For detachment of the locking claw at the engaging part, the fixing piece is required to be bent. In FIG. 5A, a deformation amount of the fixing piece 108 engaging with the locking claw 112 is indicated by an angle θ1 from a center position of the depression of the fixing piece. On the other hand, in FIG. 5B, a deformation amount of the fixing piece 108*b* is indicated by an angle θ2 from a center position of a swelling part of the locking claw 112*b* provided to the fixing piece 108*b*.

In the above case, the deformation amount of the fixing piece increases as the angle θ increases and, as a result, a load on the fixing piece also increases. It is depicted that the angle θ2 indicated in FIG. 5B becomes larger than the angle θ1 indicated in FIG. 5A, and it can be found that the load on the fixing piece in the conventional structure is larger. It can be found that the fixing piece 108*b* in the conventional structure more tends to be damaged than the fixing piece 108 of the present embodiment when the outer cover is pulled to be detached from the inner cover.

Figure 6A:
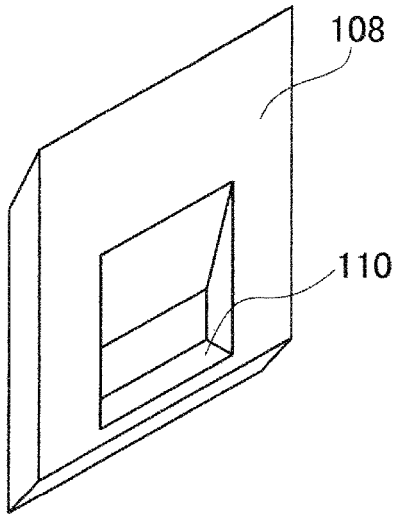
FIG. 6A is a perspective view depicting a mode of the fixing piece according to one embodiment of the present invention.

FIG. 6A depicts an enlarged view of the fixing piece 108 according to the present embodiment. The fixing piece 108 has a recessed surface part which engages with the locking claw, that is, the engaging part 110. This engaging part 110 is formed in a recessed surface part so as to engage with the protruding part (claw part) of the locking claw 112, and a through hole is not provided in the fixing piece 108. With this, even if the outer cover 106 is manufactured by injection molding or the like with a resin material, the entire fixing piece 108 is in a plate surface shape, and a weld can be prevented from being formed. With this, the present embodiment has an advantage in which the strength of the fixing piece 108 can be enhanced. Also, variation in quality for each product can be reduced.

Figure 6B:
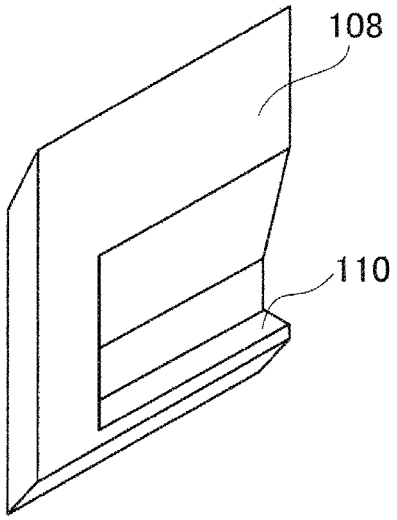
FIG. 6B is a perspective view depicting a mode of the fixing piece according to one embodiment of the present invention.

As depicted in FIG. 6B, as another mode of the fixing piece 108, one end of the engaging part 110 may be an open end. When the locking claw 112 engages with the engaging part 110, even if both are strongly engaged and firmly fit together, with this open end provided, play which allows even a little sliding of one of the locking claw and the fixing piece is provided, and the occurrence of unwanted stress to the fixing piece 108 can be prevented.

In any case, the structure of the fixing piece 108 depicted in FIG. 6A and FIG. 6B does not have a protruding part as a locking claw with a pointed claw tip. Therefore, a finger or glove can be prevented from being caught when handling the outer cover to damage the fixing piece and cause operator's injury due to the damage of the fixing piece.

Note that, although not depicted in FIG. 1, an antenna member implemented on the antenna unit 100 is provided inside the inner cover 104. Alternatively, part of the antenna member may be arranged not only inside the inner cover 104 but also between the inner cover 104 and the outer cover.

To protect the antenna member and its accompanying components, the seal member 120 may be provided between the inner cover 104 and the base plate 102. With the seal member 120 provided so as to abut on the base plate 102 and an outer edge surface of the inner cover 104, the inner region of the inner cover 104 can be made waterproof.

In this manner, according to the present embodiment, with the fixing piece which engages with the locking claw provided to the outer cover and the locking claw provided to the inner cover, damage of the fixing piece is prevented, and the outer cover can be reliably fixed. Also, with the locking claw of the inner cover provided inside the opening provided in the inner cover, the fixing piece can be engaged with the locking claw as being supported by an end part of the opening or the inner wall part. Therefore, also with this, damage of the fixing piece can be prevented. With an opening provided also in the base plate so as to match the opening of the inner cover, water infiltrating into the space surrounded by the outer cover and the inner cover can be discharged.

Second Embodiment

In the present embodiment, an antenna unit with a configuration different from that of the first embodiment and not provided with an inner cover is exemplarily described.

Figure 7:
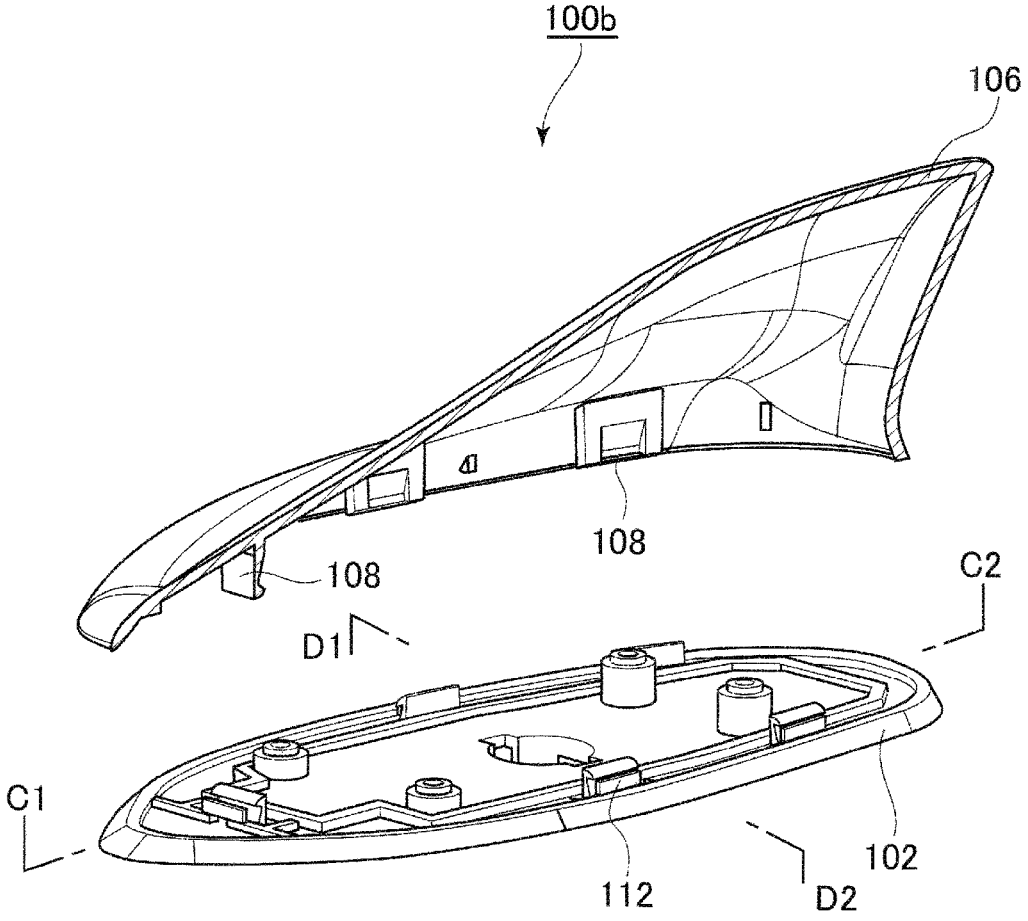
FIG. 7 is a perspective view describing the structure of an antenna unit according to one embodiment of the present invention.
Figure 8:
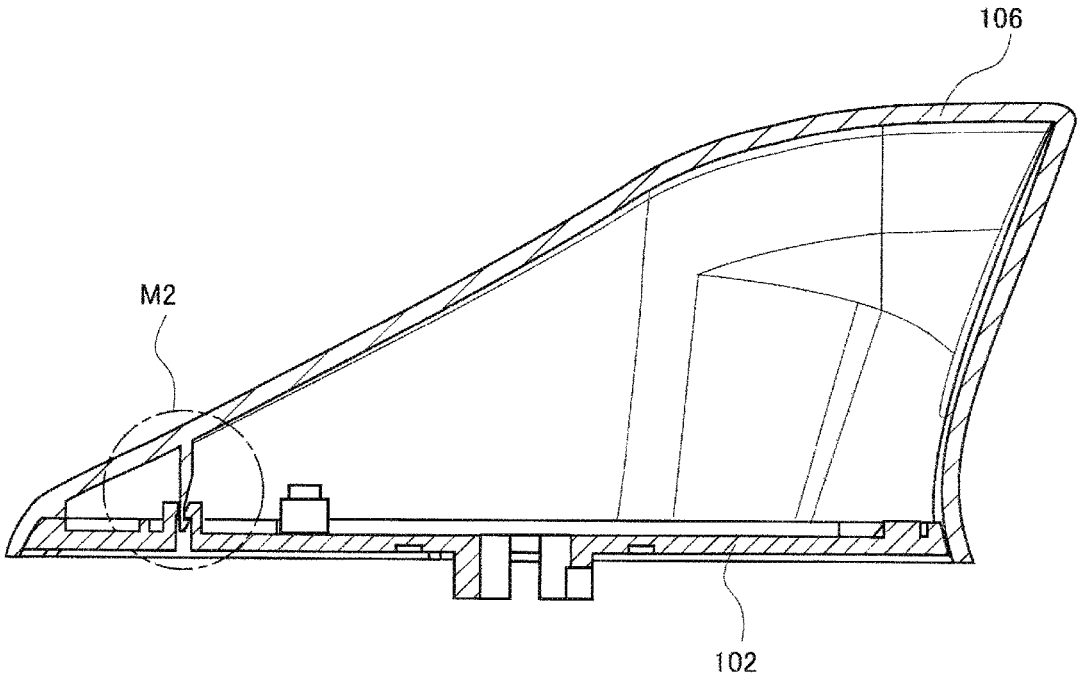
FIG. 8 is a sectional view describing the structure of the antenna unit according to one embodiment of the present invention.
Figure 8:
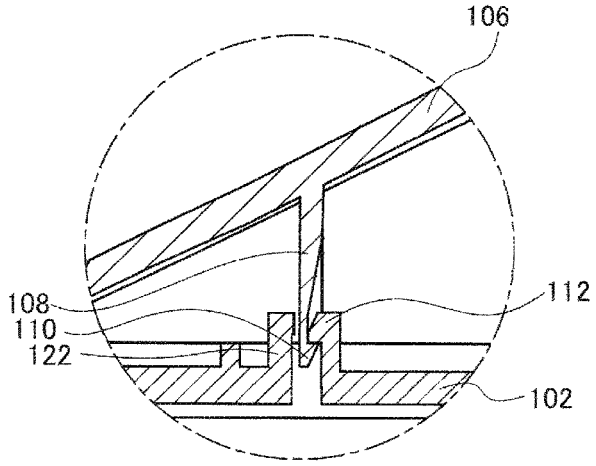
Figure 9:
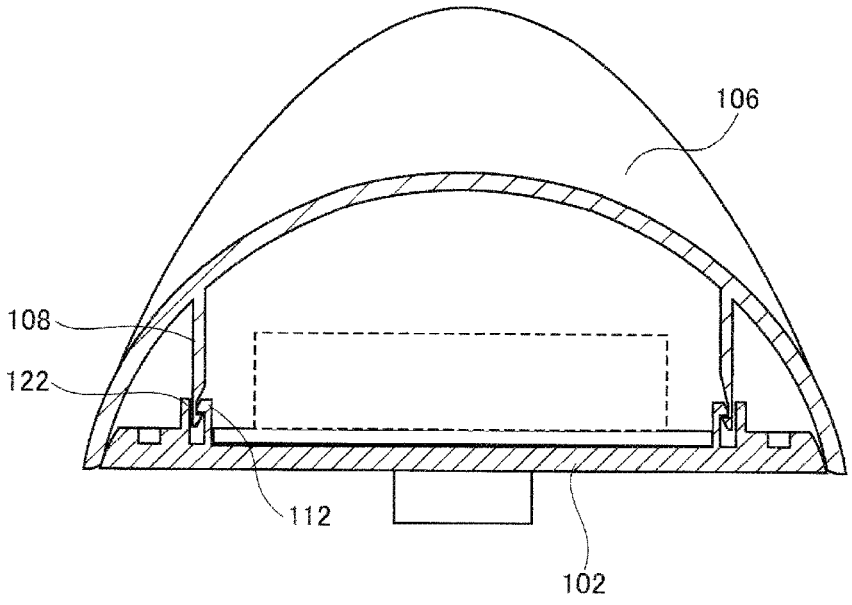
FIG. 9 is a sectional view describing the structure of the antenna unit according to one embodiment of the present invention.

FIG. 7 depicts an antenna unit 100*b* according to the present embodiment, depicting the base plate 102 and the outer cover 106. For description, FIG. 7 depicts a state in which these components are each separated. Also, a sectional view along a C1-C2 cutting line depicted in FIG. 7 is depicted in FIG. 8, and a sectional view along a D1-D2 cutting line is depicted in FIG. 9. Note that, for convenience, as for the outer cover 106, FIG. 7 depicts a sectional part when cut out in a C1-C2 direction depicted in the drawing so that the sectional part is displayed forward in the drawing.

In the antenna unit 100*b* according to the present embodiment, as depicted in FIG. 7, the locking claw 112 is provided on the outer edge part of the base plate 102. With the locking claw 112 and the fixing piece 108 of the outer cover 106 engaging with each other, the outer cover 106 is fixed to the base plate 102. As a mode of the locking claw 112 provided to the base plate 102 and the fixing piece 108 provided to the outer cover 106, one similar to that of the first embodiment is applied. An antenna member is provided in an inner region surrounded by the base plate 102 and the outer cover 106.

As depicted in the sectional views of FIG. 8 and FIG. 9, the locking claw 112 is provided between the outer edge part of the base plate 102 and a wall surface part 122 provided to stand from the base plate. By contrast, in the fixing piece 108, a plate-shaped member is provided in a state of standing from the inner wall surface of the outer cover 106, and a recessed part is provided so that a claw is engaged with a surface which engages with the locking claw. While the present embodiment has a structure with an inner cover omitted, with the locking claw 112 provided to the base plate 102, the outer cover 106 can be fixed to the base plate 102. In this case, the fixing piece 108 of the outer cover 106 directly engages with the locking claw 112 of the base plate 102, and therefore positional misalignment between the outer cover 106 and the base plate 102 can be reduced.

Preferably, the locking claws 112 are provided at a plurality of locations on the base plate 102 and, for example, are preferably provided on both left and right sides of the base plate 102 in a longitudinal direction. In addition to this, if the locking claw 112 is provided also in a direction crossing the longitudinal direction, the outer cover 106 can be more stably fixed.

In this manner, with the locking claw 112 provided to the base plate 102 and the fixing piece 108 which engages with this locking claw 112 provided on an outer cover 106 side, a claw-shaped protrusion is not required to be provided to the fixing piece 108. With this, a finger or glove can be prevented from being caught when handling the outer cover to damage the fixing piece and cause operator's injury due to the damage of the fixing piece.

Note that one mode in which the fixing piece 108 engages with the locking claw 112 is depicted in FIG. 8 as an enlarged view of a region M2 surrounded by a one-dot chain line in the drawing. With reference to the enlarged view of the M2 part, the wall surface part 122 is provided on a side opposed to the locking claw 112 provided to the base plate 102. In this one mode, the fixing piece 108 is inserted so as to be interposed between the locking claw 112 and the wall surface part 122. In this one mode, the structure is preferably such that at least part of the wall surface part 122 is in contact with or extremely in the vicinity of the fixing piece 108. With at least part of the wall surface part 122 in contact with or extremely in the vicinity of the fixing piece 108, even if an external force is applied to the outer cover 106, the fixing piece 108 is supported by the wall surface part 122, and therefore the fixing piece 108 can be prevented from being damaged.

Figure 10A:
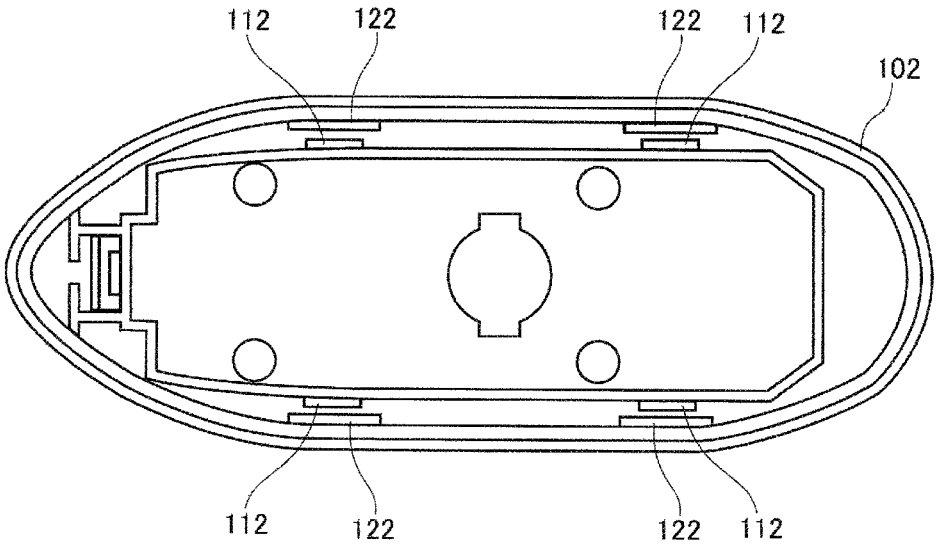
FIG. 10A is a plan view describing the structure of a base plate of the antenna unit according to one embodiment of the present invention.
Figure 10B:
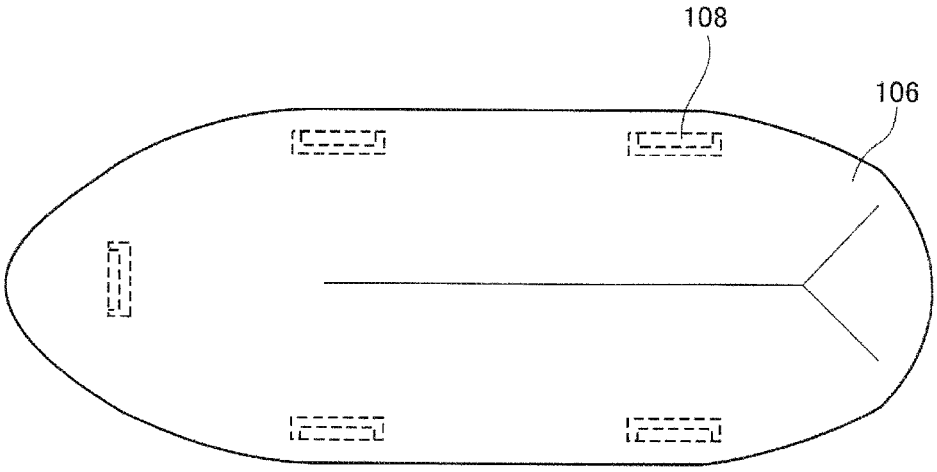
FIG. 10B is a plan view describing the structure of an outer cover of the antenna unit according to one embodiment of the present invention.

FIG. 10A and FIG. 10B depicts details of each part configuring the antenna unit 100*b*. FIG. 10A depicts a plan view of the base plate 102 and FIG. 10B depicts a plan view of the outer cover 106.

In FIG. 10A, between the outer edge part of the base plate 102 and the wall surface part 122, the locking claws 112 are provided so as to correspond to the fixing pieces 108. The locking claws 112 are preferably formed integrally with the base plate 102, thereby allowing the outer cover 106 to be stably fixed even if the outer cover 106 is attached. With the locking claws 112 integrally formed with the base plate 102, the number of components of the antenna unit can be decreased. Also, as described with reference to the enlarged view of the M2 part depicted in FIG. 8, the wall surface parts 122 may be provided so as to be opposed to the locking claws 112.

In FIG. 10B, when the outer cover 106 is viewed from the upper surface, the fixing pieces 108 do not appear on the outer surface, and are provided inside the outer cover 106. While the shape of the outer cover 106 is any, for example, as depicted in the drawing, at least paired left and right fixing pieces 108 are preferably provided along a longitudinal direction of the outer cover 106. Also, in addition to this, by providing the fixing piece 108 also in a direction crossing the longitudinal direction, the outer cover 106 can be more stably fixed to the outer cover 106.

Note that, although not depicted in FIG. 7, the antenna member implemented on the antenna unit 100*b* is provided in a region surrounded by the base plate 102 and the outer cover 106. To protect the antenna member and its accompanying components, the seal member 120 may be provided between the inner cover 104 and the base plate 102. With a through hole (114*b* of FIG. 4A) provided in the base plate 102, water can be drained. Furthermore, with a through hole (114*b* of FIG. 4A) provided in the base plate 102, the fixing pieces can be moved by using a jig or the like, and therefore the outer cover can be easily replaced.

In this manner, according to the present embodiment, with the fixing piece having the engaging part provided to the outer cover and the locking claw provided to the base plate, the fixing piece is prevented from being damaged, and the outer cover can be reliably fixed. Also, by fixing the outer cover with the locking claw provided to the base plate, attachment to the base plate can be made without misalignment of the position of the outer cover.

What is claimed is:

1. An antenna unit comprising:

a base plate where at least part of an antenna member is disposed;

an inner cover attached to the base plate so as to cover at least part of the antenna member; and an outer cover covering the inner cover on the base plate, the inner cover having a locking claw which fixes the outer cover, and the outer cover having a fixing piece which engages with the locking claw, wherein the fixing piece protrudes away from the outer cover, has a continuous surface configured to face the locking claw, and has a reduced thickness in an area of the continuous surface defining a recessed region configured to accommodate the locking claw, and the continuous surface extends across an entirety of the recessed region.

2. The antenna unit according to claim 1, wherein the inner cover has an opening at a position where the locking claw is provided, and the locking claw is provided on an inner wall surface of the opening.

3. The antenna unit according to claim 2, wherein the fixing piece of the outer cover is provided so as to fit in the opening of the inner cover.

4. The antenna unit according to claim 2, wherein a through hole is provided in the base plate so as to match the opening of the inner cover.

* * * * *